US011530541B1

(12) United States Patent
Switzer

(10) Patent No.: US 11,530,541 B1
(45) Date of Patent: Dec. 20, 2022

(54) ADJUSTABLE FORM FOR CONCRETE CONSTRUCTION

(71) Applicant: Reinhardt Switzer, Ocala, FL (US)

(72) Inventor: Reinhardt Switzer, Ocala, FL (US)

( * ) Notice: Subject to any disclaimer, the term of this patent is extended or adjusted under 35 U.S.C. 154(b) by 578 days.

(21) Appl. No.: 16/138,068

(22) Filed: Sep. 21, 2018

Related U.S. Application Data

(60) Provisional application No. 62/561,959, filed on Sep. 22, 2017.

(51) Int. Cl.
*E04G 9/08* (2006.01)
*E04G 11/36* (2006.01)
*E04G 9/06* (2006.01)

(52) U.S. Cl.
CPC ..... *E04G 9/08* (2013.01); *E04G 9/06* (2013.01); *E04G 11/365* (2013.01)

(58) Field of Classification Search
CPC ..... E04G 9/08; E04G 9/06; E04G 11/365
See application file for complete search history.

(56) References Cited

U.S. PATENT DOCUMENTS 1,214,829 A * 2/1917 Ross ..... E04G 17/0658 249/42
1,500,204 A * 7/1924 Richard ..... F16G 11/12 254/29 A
RE17,452 E * 10/1929 Hawley, Jr. ..... E04G 17/0658 249/42
2,114,590 A * 4/1938 Colt ..... E04G 17/0658 52/678
2,684,518 A * 7/1954 Whitlock ..... E04G 15/00 249/52
4,076,777 A * 2/1978 Petrovitch ..... E04G 11/04 264/32
5,655,336 A * 8/1997 Azar ..... E04G 9/06 249/19

* cited by examiner

*Primary Examiner* — Mohammad M Ameen
(74) *Attorney, Agent, or Firm* — Allen, Dyer, Doppelt & Gilchrist, P.A.

(57) ABSTRACT

An adjustable form for installing across an opening at an edge of a concrete slab includes a form member having a first form portion and a second form portion slidably connected to reach an adjustable effective length of the form member. The adjustable form further includes an extension mechanism connected between the first and second form portions and is operable to vary the effective length of the form member to fit across the opening. Tension exerted between the first and second form portions at the effective length is sufficient to keep the adjustable form in place.

15 Claims, 5 Drawing Sheets

ADJUSTABLE FORM FOR CONCRETE CONSTRUCTION

CROSS-REFERENCE TO RELATED APPLICATION

The present application claims the benefit of U.S. Provisional Patent Application Ser. No. 62/561,959, filed on Sep. 22, 2017, the contents of which are herein incorporated by reference in their entirety.

FIELD OF THE INVENTION

The present invention relates to the field of concrete construction and, more particularly, to an adjustable form to block concrete leakage in concrete pouring.

BACKGROUND OF THE INVENTION

In modern construction, particularly construction of large commercial or industrial structures, a common practice is to precast large concrete elements and assemble them on site. For example, precast flooring slabs are brought to a site and suspended between precast columns, wall structures, or the like. The approach enables relatively quick and robust assembly, but often a different finished surface is required or desired. In such cases, an on-site pour might be made over all or part of the tops of precast slabs once in place for the sake of drainage grading, appearance, or other purposes. Depending on building geometry, on-site pours often require the erection of temporary formwork to stop poured concrete flowing over sides of the precast slabs.

The overflow problem is frequently met in parking garage construction. Referring to FIG. 6, in a common precast parking garage 46, precast slabs 40 are used to the form the driving/parking surfaces, including ramps 48 extending between levels. The slabs 40 are supported by precast vertical structures 50. To allow light to penetrate through the interior of the garage 46, the vertical structures 50 often feature internal openings 38. When doing an on-site pour over the precast slabs 40, temporary formwork must be installed across each opening 38, requiring time and labor. A further complication is that the angle at which the slabs 40 traverse the openings 38 might not be precisely the same each time, nor might the effective length of the opening to be blocked by formwork be precisely the same. Additionally, edges of slabs 40 might not be perfectly aligned adjacent to the openings 38.

Currently, carpenters are employed to build a separate wood form for each opening 38, with each separate form being custom cut and installed to fit. While the approach works, it might not be acceptable, because apart from the time and labor required the finished appearance of edges of the pour will often be quite inconsistent from opening to opening. It is therefore desirable to address this problem in a way that can save time and labor costs and achieve a more consistent result.

SUMMARY OF THE INVENTION

In view of the foregoing, it is an object of the present invention to provide an adjustable form for concrete construction. An adjustable form for installing across an opening at an edge of a concrete slab includes a form member having a first form portion and a second form portion slidably connected to reach an adjustable effective length of the form member. The adjustable form further includes an extension mechanism connected between the first and second form portions and is operable to vary the effective length of the form member to fit across the opening. Tension exerted between the first and second form portions at the effective length is sufficient to keep the adjustable form in place.

A method of installing an adjustable form across an opening at an edge of one or more concrete slabs includes positioning the adjustable form between opposite sides of the opening and underside of the one or more concrete slabs. An extension mechanism of the adjustable form is operated to extend an overall length of the form member until tension exerted between the first and second form portions is sufficient to keep the adjustable form in place. The overall length of the form is then secured.

These and other objects, aspects and advantages of the present invention will be better appreciated in view of the drawings and following detailed description of preferred embodiments.

DETAILED DESCRIPTION OF PREFERRED EMBODIMENTS

Figure 1:
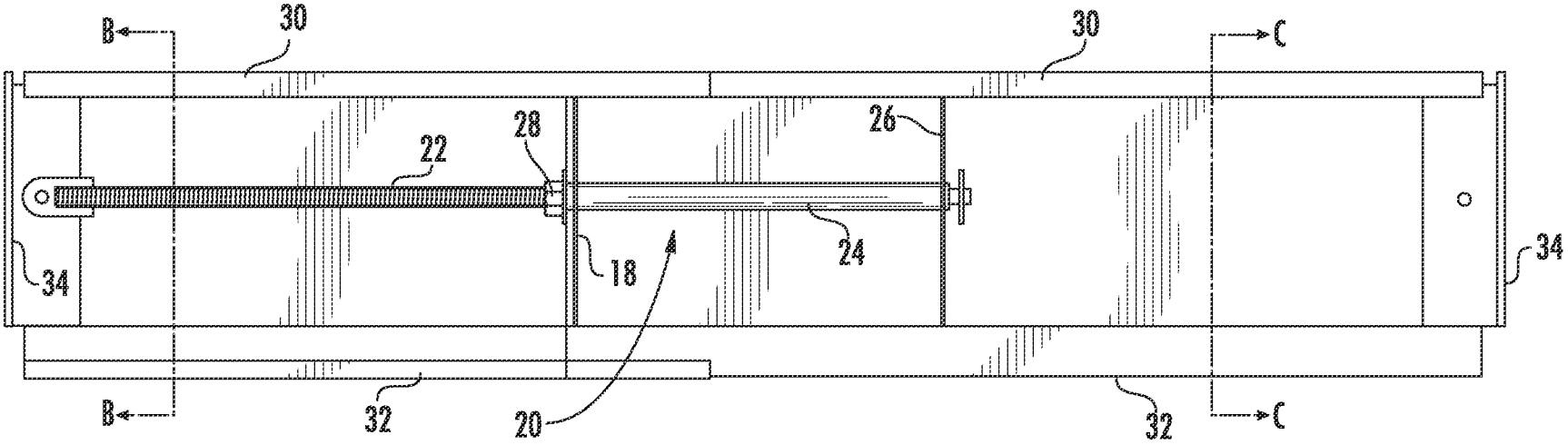
FIG. 1 is a back view of an adjustable form, according to one embodiment of the present invention.
Figure 3:
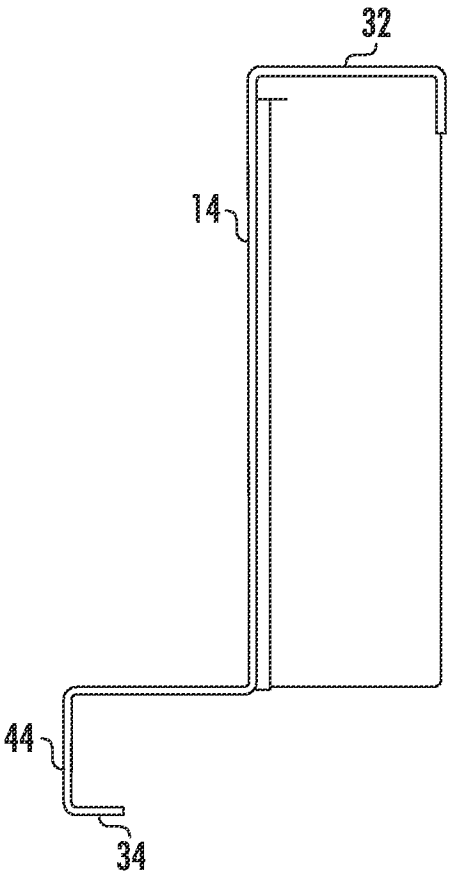
FIG. 3 is another side view of the adjustable form.
Figure 2:
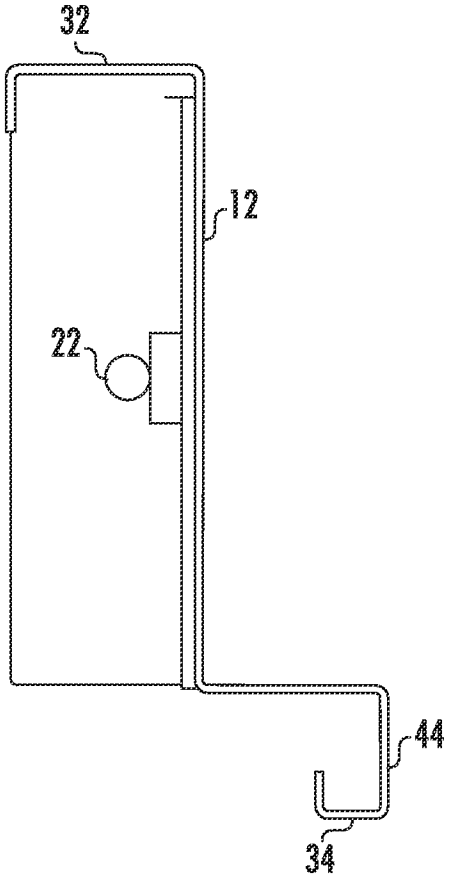
FIG. 2 is a side view of the adjustable form.

Referring to FIGS. 1-3, according to an embodiment of the present invention, an adjustable form 10 includes a form member 12 having a first form portion 14 and a second form portion 12 slidably connected such that an effective length 18 of the form member 12 can be adjusted. An extension mechanism 20 is connected between the first and second form portions 12 and 14 and is operable to vary the effective length 18 of the form member 12.

In the depicted embodiment, the first form portion and the second form portion are planar panels to effectively prevent the poured concrete from flowing over sides of the precast slabs. The extension mechanism 20 includes an extension screw 22 positioned partially through an elongated barrel 24 secured between two vertical members 26 of the back side of the first planar form portion 14. The barrel 24 serves as a guide to receive the screw 22 between respective openings in the vertical members 26. The first and second portions 12 and 14 can freely slide apart, with tension being applied via the screw 22 engaging one or more of the vertical member 26. When a desired distance between the first form portion 12 and second form portion 14 are achieved, the position of the extension screw 22 is secured via securing a bolt 28 to at least one of the two vertical members 26. Other types of fasteners and extension arrangement can also be used.

The first form portion 12 and second form portion 14 of the adjustable form 10 each has a horizontal top bracket 30 on a top edge. The top brackets 30 serve as an upper sliding track for the first and second form portions 12 and 14. Specifically, the top bracket 30 of the first form portion 12 is dimensioned to be slightly larger than the top bracket 30 of the second form portion 14 such that the top bracket 30 of the second member 14 can slide inside the top bracket 26 of the first form portion 12.

The first form portion 12 and second form portion 14 of the adjustable form 10 each has a bottom lip 32 on a bottom edge. The bottom lips 32 of the first and second form portion 12 and 14 partially overlap and run substantially the entire length of the lower edge of the form member 12. In the depicted embodiment, the bottom lip 32 of the first form portion 12 is U-shaped and the bottom lip 32 of the second form portion 14 is L-shaped. Other suitable sizes and shapes of bottom lips 32 can be used for a bottom sliding track for the first and second form portions 12 and 14. The bottom lips 32 can also be configured to be positioned underneath the slab 40 in the area of the gap 42 between the slab 40 and the adjustable form 10, providing a lower form for poured concrete that flows into the gap and retain any unset concrete that could otherwise leak through the gap 42, as shown in FIGS. 4 and 5.

The adjustable form 10 can further include two flanges 34 connected at respective ends of the form member 12. Preferably, each flange 34 is pivotally connected to respective end of the form member 12. The pivotal engagement enable the flange 34 to rotate within a certain angle (e.g., 15 degrees) around the respective ends such that the flange 34 can always follow the angle of the slab 40, which can be non-perpendicular to the sides of the opening 38, as shown in FIGS. 4 and 5. Pads 36 can also be attached to the end surfaces of the respective flanges 34 to enhance engagement of adjacent structures at opposite ends of the adjustable form 10, as shown in FIG. 4.

Figure 4:
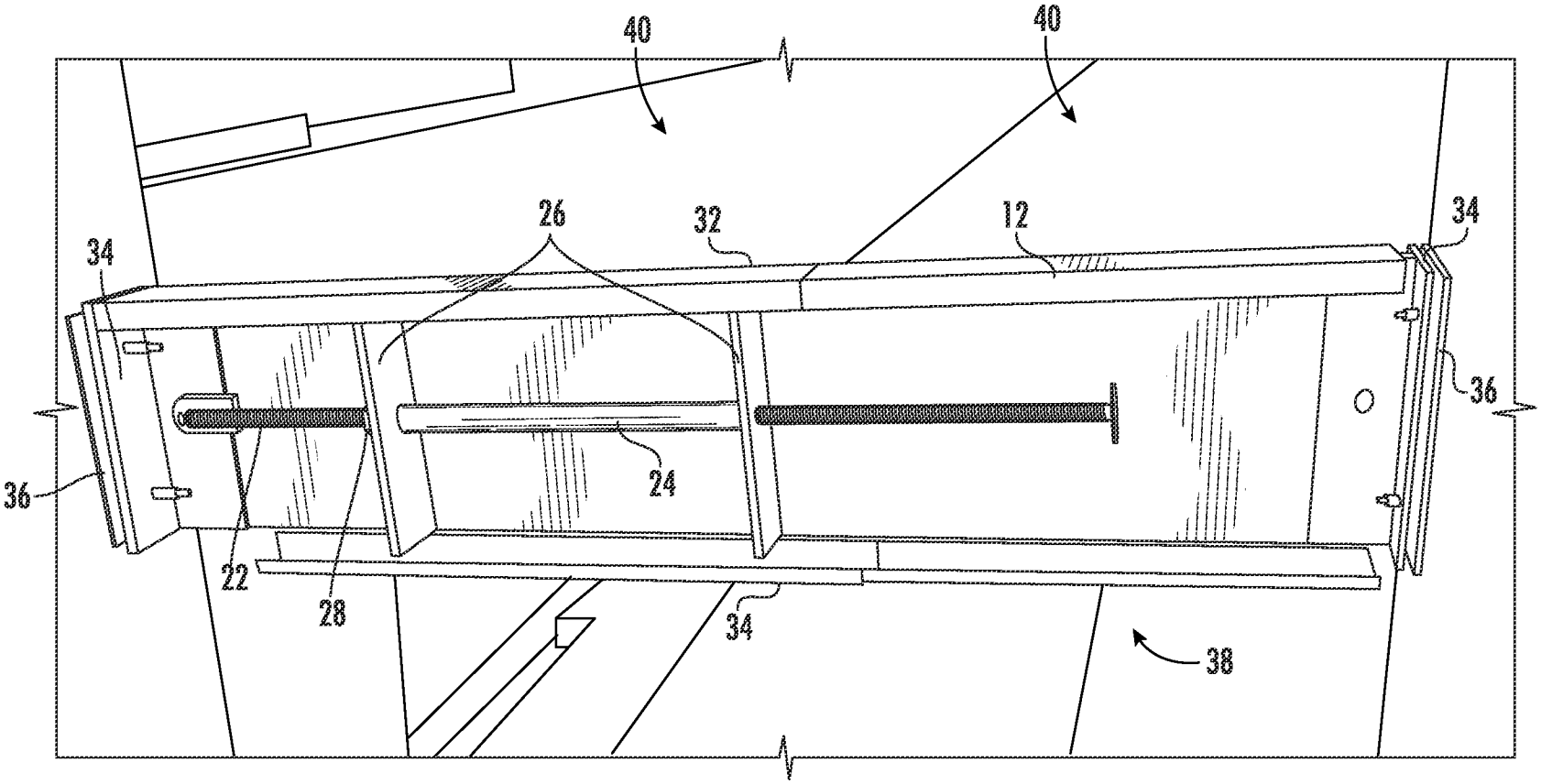
FIG. 4 is a perspective view of the adjustable form of FIG. 1 in use, according to one embodiment of the present invention.
Figure 5:
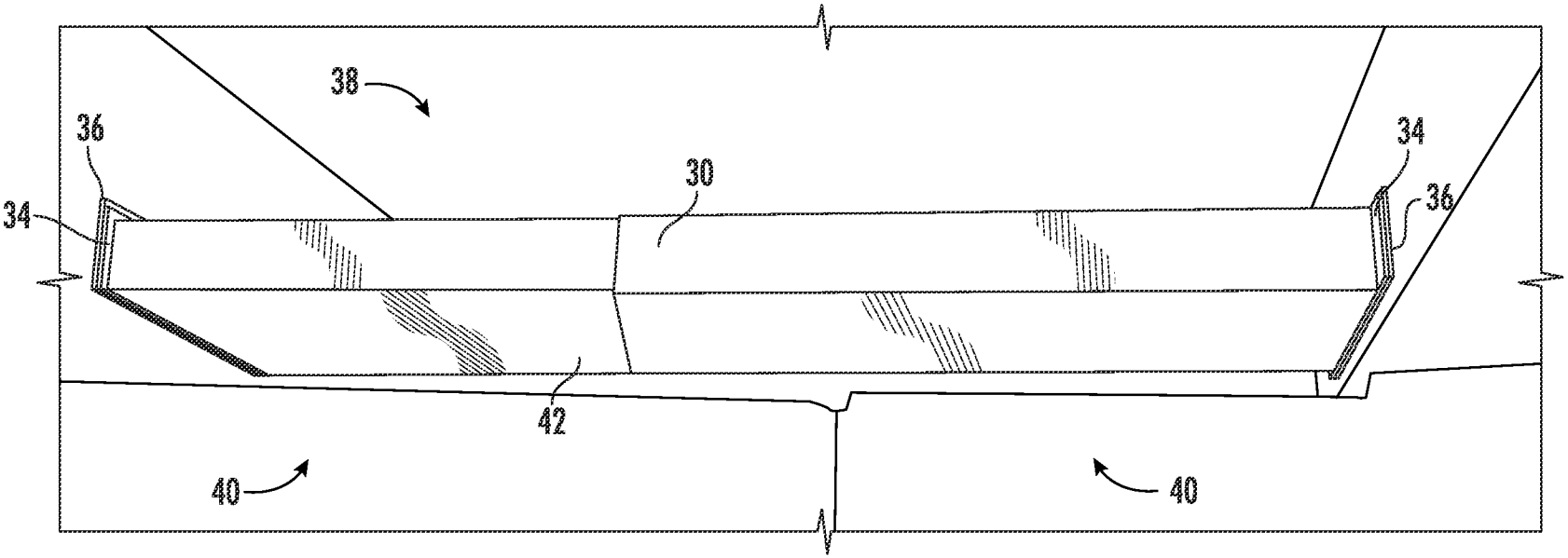
FIG. 5 is a top view of the adjustable form of FIG. 1 in use, according to one embodiment of the present invention.
Figure 6:
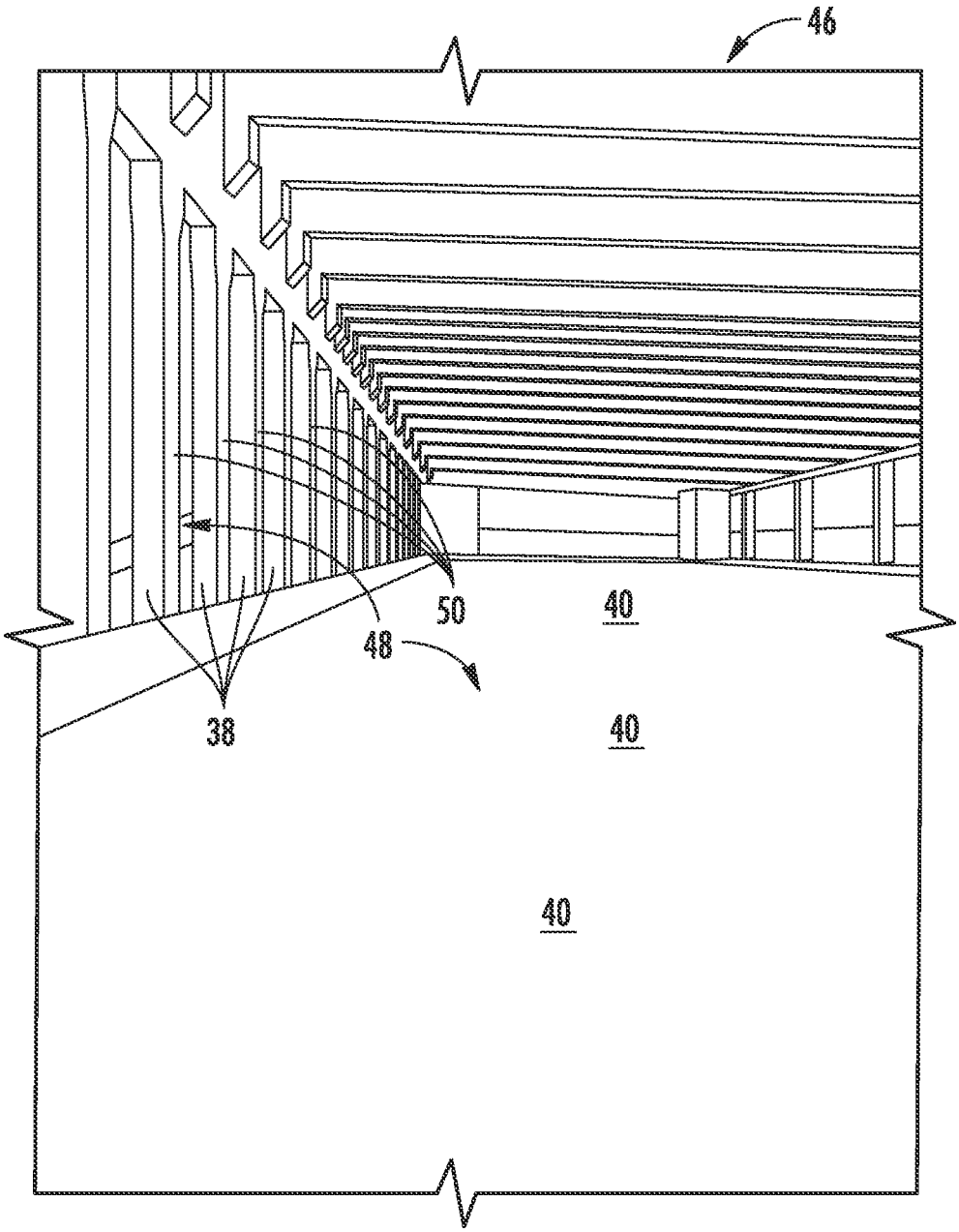
FIG. 6 is an elevational view of a concrete parking structure.

In use, referring to FIGS. 4-5, the adjustable form 10 is installed across the opening 38 at the edge of one or more slabs 40. Specifically, the bottom lips 32 of the adjustable form 10 can be positioned at the underside of the one or more slabs 40. The extension mechanism 18 is operated to extend the overall length of the form member 10 until the two flanges 34 securely engage opposite sides of the opening 38. In the depicted embodiment, as the two flanges 34 are both pivotally connected to both sides of the adjustable form 10, they can rotate slightly (e.g., within 15 degrees) to enable the two flanges 34 to flatly and securely engage the opposite sides of the opening 38 despite the form member 12 following the angle of the one or more slabs 40, which is non-perpendicular to the sides of the opening 38. When a desired overall length is achieved, tension exerted between the first and second form portions 12 and 14 via the extension screw 22 is sufficient to keep the flanges 34 in place. Subsequently, concrete can be poured and cured without the need for any additional fasteners to hold the adjustable form 10 in place. When pouring concrete, the bottom lips 32 are also configured to be positioned underneath the slab 40 in the area of the gap 42 between the slab 40 and the adjustable form 10, providing a lower form for poured concrete that flows into the gap 42 and retain any unset concrete that could otherwise leak through the gap 42.

Generally, the effective length range achievable by the adjustable form 10 is determined based on the expected range of opening widths in which the form 10 is to be used. Likewise, the height 44 and the bottom lip 32 are dimensioned such that the bottom lip 32 can effectively seal the bottom of any expected gap with the top of the form member 12 extending above the top of the adjacent slab(s) to a height sufficient to contain the expected height of the pour.

The adjustable form 10 can be constructed from metal, polyethylene, polyvinyl chloride, or polybutylene because of the strength and flexibility of these materials. The adjustable form 10 is preferably made of 16-18 gauge steel. Other suitable material can also be used for the same purpose.

Once the concrete pour has cured sufficiently, the tension is removed by operation of the extension mechanism and the adjustable form 10 can be removed and relocated, as necessary. For example, the overall length of the adjustable form 10 can be shorted by rotating the bolt 28 away from at least one of the two vertical members 26 along the extension screw 22 such that the extension screw 22 can move toward the direction to lead to more overlap of the first and second form portions 12 and 14. It will be appreciated that, for a given job, a plurality of adjustable forms 10 can be used simultaneously, depending on the extent of the area to poured. After the pour has cured in such area, then the adjustable forms 10 can be quickly removed and reinstalled at the next area to be poured, or taken to another job site. It will be appreciated that the use of an adjustable form according to the present invention can greatly improve the speed and ease of installation, as well as the consistency of the resulting pour.

In general, the foregoing description is provided for exemplary and illustrative purposes; the present invention is not necessarily limited thereto. For example, construction materials described herein are believed to represent preferred embodiments, but other suitable construction materials could be used within the scope of the invention. Those skilled in the art will appreciate that additional modifications, as well as adaptations for particular circumstances, will fall within the scope of the invention as herein shown and described and of the claims appended hereto.

What is claimed is:

1. An adjustable form for installation across an opening at an edge of a concrete slab comprising:

a form member having a first form portion and a second form portion slidably connected to reach an adjustable effective length of the form member in a length direction; and an extension mechanism being connected between the first and second form portions and operable to vary the effective length of the form member to fit across the opening, the extension mechanism including an extension rod extending along the form member in the length direction from a first end connected to the second form portion through a guide extending in the length direction and connected to the first form portion;

wherein tension exerted between the first and second form portions by the extension member at the effective length is sufficient to keep the adjustable form in place.

2. The adjustable form of claim 1, wherein the extension rod is an extension screw and the guide is an elongated barrel secured between two vertical members on a back side of the first form portion.

3. The adjustable form of claim 2, further comprising a bolt rotatably mounted on the extension screw, wherein position of the extension screw is secured via securing the bolt to the at least one of the two vertical members when a desired distance between the first form portion and second form portion is achieved.

4. The adjustable form of claim 1, wherein the first form portion and second form portion of the adjustable form each has a horizontal top bracket on a top edge, wherein the top brackets are configured to serve as a sliding track for the first and second form portions.

5. The adjustable form of claim 4, wherein the top bracket of the first form portion is dimensioned to be slightly larger than the top bracket of the second form portion such that the top bracket of the second member slide inside the top bracket of the first form portion.

6. The adjustable form of claim 1, wherein the first form portion and second form portion of the adjustable form each has a bottom lip on a bottom edge.

7. The adjustable form of claim 6, wherein the bottom lips of the first and second form portion partially overlap and run substantially the entire length of the lower edge of the form member.

8. The adjustable form of claim 6, wherein the bottom lip of the first form portion is U-shaped and the bottom lip of the second form portion is L-shaped.

9. The adjustable form of claim 1, further comprising two flanges connected at respective ends of the form member.

10. The adjustable form of claim 9, wherein the two flanges are pivotably connected at respective ends of the form member.

11. The adjustable form of claim 9, wherein a pad is attached to an end surface of the respective flanges to enhance engagement of adjacent structures at opposite ends of the adjustable form.

12. The adjustable form of claim 1, wherein the first form portion and the second form portion are both planar.

13. The adjustable form of claim 1, wherein the adjustable form is made of at least one of metal, polyethylene, polyvinyl chloride, and polybutylene.

14. The adjustable form of claim 1, wherein the adjustable form is made of steel.

15. An adjustable form for installation across an opening at an edge of a concrete slab comprising:

a form member having a first form portion and a second form portion slidably connected to reach an adjustable effective length of the form member in a length direction;

an extension mechanism being connected between the first and second form portions and operable to vary the effective length of the form member to fit across the opening; and two flanges connected at respective ends, in the length direction, of the form member;

wherein tension exerted between the first and second form portions at the effective length is sufficient to keep the adjustable form in place; and wherein the two flanges are pivotably connected at respective ends of the form member so as to be positionable at variable angles relative thereto.

* * * * *